US007753209B2

(12) United States Patent
McDonald et al.

(10) Patent No.: US 7,753,209 B2
(45) Date of Patent: Jul. 13, 2010

(54) SUSPENSION PACKAGE ASSEMBLY

(76) Inventors: John McDonald, 1088 Via Prado, Fallbrook, CA (US) 92028; Frank Comerford, 20 Hermitage La., Laguna Niguel, CA (US) 92677; Myles Comerford, 17147 Sobre Los Cerros, Rancho Santa Fe, CA (US) 92091

( * ) Notice: Subject to any disclaimer, the term of this patent is extended or adjusted under 35 U.S.C. 154(b) by 242 days.

(21) Appl. No.: 11/412,693

(22) Filed: Apr. 27, 2006

(65) Prior Publication Data

US 2007/0251854 A1 Nov. 1, 2007

(51) Int. Cl.
*B65D 85/30* (2006.01)

(52) U.S. Cl. ..... 206/583; 206/591; 206/784

(58) Field of Classification Search ..... 206/583, 206/591, 594, 784; 229/101, 104
See application file for complete search history.

(56) References Cited

U.S. PATENT DOCUMENTS

| | | | | |
|---|---|---|---|---|
| 1,821,692 | A * | 9/1931 | Copeland | 206/586 |
| 2,161,128 | A | 6/1939 | Boyle | |
| 2,948,455 | A | 8/1960 | Frankenstein | |
| 2,956,672 | A | 10/1960 | Kirkpatrick | |
| 3,047,137 | A | 7/1962 | Kindseth | |
| 3,326,410 | A | 6/1967 | Asenbauer | |
| 3,345,643 | A | 10/1967 | Bradley | |
| 3,853,220 | A | 12/1974 | Luray | |
| 3,905,474 | A | 9/1975 | Haibara | |
| 3,917,108 | A | 11/1975 | Thurman | |
| 4,077,518 | A | 3/1978 | Kisslinger et al. | |
| 4,155,453 | A | 5/1979 | Ono | |
| 4,606,460 | A | 8/1986 | Luray | |
| 4,852,743 | A | 8/1989 | Ridgeway | |
| 4,923,065 | A | 5/1990 | Ridgeway | |
| 5,046,659 | A | 9/1991 | Warburton | |
| 5,056,665 | A | 10/1991 | Boecker et al. | |
| 5,071,009 | A | 12/1991 | Ridgeway | |
| 5,076,436 | A | 12/1991 | Bortolani et al. | |
| 5,080,497 | A | 1/1992 | Peppiatt | |
| 5,183,159 | A | 2/1993 | Hojnacki et al. | |

(Continued)

FOREIGN PATENT DOCUMENTS

| | | |
|---|---|---|
| DE | 299 21 203 | 2/2000 |

(Continued)

OTHER PUBLICATIONS

Office Action dated Feb. 14, 2006 from U.S. Appl. No. 10/726,256, filed Dec. 2, 2003.

(Continued)

*Primary Examiner*—Mickey Yu
*Assistant Examiner*—Jenine M Pagan
(74) *Attorney, Agent, or Firm*—Knobbe Martens Olson & Bear LLP

(57) ABSTRACT

A suspension packaging assembly includes a packaging member having a base member and at least one lateral support wall. Preferably, the packaging member includes a pair of opposing support walls. The base member is connected to the support walls through one or more compound joints, which are configured to permit displacement of the base member relative to the support walls. The packaging assembly may include a stretchable retention member, which cooperates with the packaging member to suspend at least one article.

9 Claims, 10 Drawing Sheets

U.S. PATENT DOCUMENTS

| | | | | |
|---|---|---|---|---|
| 5,211,290 | A | 5/1993 | Janus et al. | |
| 5,218,510 | A | 6/1993 | Bradford | |
| 5,223,121 | A | 6/1993 | Dickie et al. | |
| 5,226,542 | A | 7/1993 | Boecker et al. | |
| 5,251,760 | A | 10/1993 | Smith et al. | |
| 5,323,896 | A | 6/1994 | Jones | |
| 5,372,257 | A | 12/1994 | Beauchamp et al. | |
| 5,388,701 | A | 2/1995 | Ridgeway | |
| 5,394,985 | A | 3/1995 | Van Hest | |
| 5,405,000 | A | 4/1995 | Hagedon et al. | |
| 5,492,223 | A | 2/1996 | Boardman et al. | |
| 5,579,917 | A | 12/1996 | Lofgren et al. | |
| 5,641,068 | A | 6/1997 | Warner | |
| 5,669,506 | A | 9/1997 | Lofgren et al. | |
| 5,676,245 | A | 10/1997 | Jones | |
| 5,678,695 | A | 10/1997 | Ridgeway | |
| 5,694,744 | A | 12/1997 | Jones | |
| 5,722,541 | A | 3/1998 | Lofgren et al. | |
| 5,738,218 | A | 4/1998 | Gonzales | |
| 5,769,235 | A | 6/1998 | Keach et al. | |
| 5,788,081 | A | 8/1998 | Bates | |
| 5,797,493 | A | 8/1998 | Watson | |
| 5,803,267 | A | 9/1998 | Tu et al. | |
| 5,823,348 | A | 10/1998 | Phillips et al. | |
| 5,823,352 | A | 10/1998 | Mena et al. | |
| 5,893,462 | A | 4/1999 | Ridgeway | |
| 5,894,932 | A | 4/1999 | Harding et al. | |
| 5,954,203 | A | 9/1999 | Marconi | |
| 5,967,327 | A * | 10/1999 | Jones | 206/583 |
| RE36,412 | E | 11/1999 | Jones | |
| 5,975,307 | A * | 11/1999 | Harding et al. | 206/583 |
| 5,988,387 | A | 11/1999 | Staal et al. | |
| 6,006,917 | A | 12/1999 | Loeffler | |
| 6,010,003 | A | 1/2000 | Wilkinson | |
| 6,073,761 | A * | 6/2000 | Jones | 206/223 |
| 6,079,563 | A | 6/2000 | Katchmazenski | |
| 6,119,863 | A | 9/2000 | Lofgren et al. | |
| 6,148,591 | A | 11/2000 | Ridgeway et al. | |
| 6,158,589 | A | 12/2000 | Smith et al. | |
| 6,206,194 | B1 | 3/2001 | Beneroff et al. | |
| 6,223,901 | B1 | 5/2001 | Lofgren et al. | |
| 6,289,655 | B1 | 9/2001 | Ridgeway et al. | |
| 6,311,843 | B1 | 11/2001 | Smith et al. | |
| 6,311,844 | B1 * | 11/2001 | Ridgeway et al. | 206/583 |
| 6,398,412 | B2 | 6/2002 | Wedi et al. | |
| 6,467,624 | B1 | 10/2002 | Lofgren et al. | |
| 6,675,973 | B1 | 1/2004 | McDonald et al. | |
| 6,899,229 | B2 * | 5/2005 | Dennison et al. | 206/583 |
| 6,920,981 | B2 | 7/2005 | Lofgren et al. | |
| 6,942,101 | B2 * | 9/2005 | Lofgren et al. | 206/583 |
| 7,000,774 | B2 | 2/2006 | Bryant | |
| 7,086,534 | B2 | 8/2006 | Roesel et al. | |
| 7,150,356 | B2 | 12/2006 | Lofgren et al. | |
| 7,290,662 | B2 | 11/2007 | Lofgren et al. | |
| 7,296,681 | B2 | 11/2007 | McDonald et al. | |
| 2001/0047950 | A1 | 12/2001 | Beneroff et al. | |
| 2003/0034273 | A1 * | 2/2003 | Auclair | 206/583 |
| 2003/0209463 | A1 * | 11/2003 | Halpin | 206/583 |
| 2003/0234207 | A1 | 12/2003 | Koike | |
| 2004/0108239 | A1 | 6/2004 | McDonald et al. | |
| 2004/0129601 | A1 * | 7/2004 | Lofgren et al. | 206/583 |
| 2004/0178113 | A1 * | 9/2004 | Lofgren et al. | 206/583 |
| 2005/0011807 | A1 * | 1/2005 | Dennison et al. | 206/583 |
| 2005/0121354 | A1 * | 6/2005 | Gillis et al. | 206/583 |
| 2006/0000743 | A1 | 1/2006 | Lofgren et al. | |
| 2006/0042995 | A1 | 3/2006 | McGrath et al. | |
| 2006/0102515 | A1 | 5/2006 | McDonald et al. | |
| 2006/0138018 | A1 | 6/2006 | McDonald et al. | |
| 2006/0213803 | A1 | 9/2006 | Saitou et al. | |
| 2007/0080095 | A1 | 4/2007 | McDonald et al. | |
| 2008/0067103 | A1 | 3/2008 | McDonald et al. | |
| 2008/0099368 | A1 | 5/2008 | McDonald et al. | |
| 2008/0110788 | A1 | 5/2008 | Keiger | |
| 2008/0110794 | A1 | 5/2008 | Anderson et al. | |
| 2008/0128316 | A1 | 6/2008 | McDonald et al. | |
| 2008/0223750 | A1 | 9/2008 | McDonald et al. | |
| 2009/0272667 | A1 | 11/2009 | McDonald et al. | |

FOREIGN PATENT DOCUMENTS

| | | |
|---|---|---|
| DE | 101 05 487 | 8/2002 |
| EP | 1 561 693 A1 | 8/2005 |
| RU | 827346 | 5/1981 |
| WO | WO 00/53499 | 9/2000 |

OTHER PUBLICATIONS

Office Action dated Aug. 2, 2006 from U.S. Appl. No. 10/726,256, filed Dec. 2, 2003.
Office Action dated Jan. 26, 2007 from U.S. Appl. No. 10/726,256, filed Dec. 2, 2003.
Office Action dated May 21, 2007 from U.S. Appl. No. 10/726,256, filed Dec. 2, 2003.
Office Action dated Jan. 25, 2008 from U.S. Appl. No. 10/726,256, filed Dec. 2, 2003.
Office Action dated Jun. 28, 2007 from U.S. Appl. No. 10/990,095, filed Nov. 15, 2004.
European Search Report dated Feb. 13, 2006 for European Application No. 05013333.9, filed Jun. 21, 2005, Applicants: John McDonald et al. (4 pages).
European Search Report dated Feb. 10, 2006 for European Application No. 05013375.0, filed Jun. 21, 2005, Applicants: John McDonald et al. (2 pages).
International Search Report dated May 23, 2008 from PCT/US2007/086532, filed on Dec. 5, 2007, Applicants: John McDonald et al. (2 pages).
Written Opinion of International Searching Authority dated My 23, 2008 from PCT/US2007/086532, filed on Dec. 5, 2007, Applicants: John McDonald et al.
Co-pending U.S. Appl. No. 10/726,256, filed on Dec. 2, 2003 Title: Suspension Packaging Assembly.
Co-pending U.S. Appl. No. 11/606,470, filed on Nov. 30, 2006 Title: Suspension Packaging Assembly.
Co-pending U.S. Appl. No. 11/633,712, filed on Dec. 5, 2006 Title: Suspension Packaging Assembly.
Co-pending U.S. Appl. No. 11/687,443, filed on Mar. 16, 2007 Title: Suspension Packaging Assembly.
Co-pending U.S. Appl. No. 11/943,514, filed on Nov. 20, 2007 Title: Suspension Packaging System.
Co-pending U.S. Appl. No. 11/965,591, filed on Dec. 27, 2007 Title: Suspension Packaging System.
Co-pending U.S. Appl. No. 12/497,474, filed on Jul. 2, 2009 Title: Suspension Packaging System.
Co-pending U.S. Appl. No. 12/508,473, filed on Jul. 23, 2009 Title: Suspension Packaging Assembly.
International Search Report dated Sep. 30, 2008 from PCT/US07/10010, filed on Apr. 26, 2007 (5 pages).
Written Opinion of International Searching Authority dated Sep. 30, 2008 from PCT/US07/10010, filed on Apr. 26, 2007 (8 pages).

* cited by examiner

SUSPENSION PACKAGE ASSEMBLY

BACKGROUND OF THE INVENTION

1. Field of the Invention

The present inventions are directed to a package assembly, for example, a suspension package assembly that includes a substantially rigid packaging member, which permits displacement of an article support surface relative to a lateral wall of the packaging member. The suspension package assembly may also include a stretchable retention member.

2. Description of the Related Art

Protective packaging devices are often used to protect goods from shocks and impacts during shipping or transportation. For example, when transporting articles that are relatively fragile, it is often desirable to cushion the article inside a box to protect the article from a physical impact with the inner walls of the box that might be caused by shocks imparted to the box during loading, transit, and/or unloading.

In most cases, some additional structure is used to keep the article from moving uncontrollably within the box. Such additional structures include paper or plastic packing material, structured plastic foams, foam-filled cushions, and the like. Ideally, the article to be packaged is suspended within the box so as to be spaced from at least some of the walls of the box, thus protecting the article from other foreign objects which may impact or compromise the outer walls of the box.

U.S. Pat. No. 6,675,973 discloses a number of inventions directed to suspension packaging assemblies which incorporate frame members and one or more retention members. For example, many of the embodiments of the U.S. Pat. No. 6,675,973 patent include the use of a retention member formed of a resilient material. Additionally, some of the retention members include pockets at opposite ends thereof.

In several of the embodiments disclosed in the U.S. Pat. No. 6,675,973 patent, free ends of the frame members are inserted into the pockets of the retention member. The free ends of the frame member are then bent, pivoted, or folded to generate the desired tension in the retention member. Because the retention member is made from a resilient material, the retention member can stretch and thus provide a mechanism for suspending an article to be packaged, for example, within a box.

SUMMARY OF THE INVENTION

An aspect of at least one of the embodiments disclosed herein includes the realization that certain aspects of packaging materials can be improved by permitting displacement of an article support surface of the packaging member of a packaging assembly with respect to a support portion of the packaging member. For example, a base member of the packaging member may be movable relative to one or more supporting walls of the packaging member.

Thus, in accordance with an embodiment, a packaging kit for packaging an article and maintaining the article in a position spaced from a wall of a container includes a resilient member and a substantially rigid member. The resilient member includes a body portion and first and second end portions disposed at opposite ends of the body portion. The substantially rigid member includes a base member configured to engage the article. The substantially rigid member also includes a first foldable portion and a second foldable portion configured to be pivotal relative to the base member. The first end portion of the resilient member is configured to be coupled to the first foldable portion and the second end portion of the resilient member is configured to be coupled to the second foldable portion. Accordingly, the first and second foldable portions may be pivoted relative to the base to tension the resilient member. The substantially rigid member further includes a first lateral wall portion and a second lateral wall portion. A first connecting portion is configured to connect the first lateral wall portion to the base member and a second connecting portion is configured to connect the second lateral wall portion to the base member. Each of the first and second connecting portions comprises a plurality of fold lines which permit displacement of the base relative to the wall, preferably in a direction generally parallel to the wall.

Another embodiment is a substantially rigid packaging member that includes a base member and at least one support wall. The base member is configured to engage an article. The support wall is connected to the base through a compound joint configured to permit the at least one wall to be moved relative to the base from an unfolded position to a folded position. A compound joint is further configured to permit displacement of the base relative to the at least one support wall, preferably in a direction generally parallel to the support wall when the support wall is in the folded position.

Still another embodiment is a substantially rigid suspension-packaging member including a base configured to engage an article and at least one wall. The at least one wall is coupled to the base and configured to be movable relative to the base from an unfolded position to a folded position. The suspension packaging member also includes means for permitting the base to move in a direction generally parallel to the at least one wall when the at least one wall us is in the folded position.

For the purposes of summarizing the inventions and the advantages achieved over the prior art, certain objects and advantages of the inventions have been described hereinabove. Of course, it is to be understood that not necessarily all such objects or advantages may be achieved in accordance with any particular embodiment of the inventions. Thus, for example, those skilled in the art will recognize that the inventions may be embodied or carried out in a manner that achieves or optimizes one advantage or a group of advantages as taught herein without necessarily achieving other objects or advantages as may be taught or suggested herein.

All of these embodiments are intended to be within the scope of the inventions disclosed herein. These and other embodiments of the inventions will become readily apparent to those skilled in the art from the following detailed description of the preferred embodiments having reference to the attached figures, the inventions not be limited to any particular preferred embodiments disclosed.

BRIEF DESCRIPTION OF THE DRAWINGS

These and other features of the inventions are described below with reference to the drawings of several, embodiments of the present package assemblies and packaging members which are intended to illustrate, but not to limit, the inventions. The drawings contain 17 figures.

FIG. 10 illustrates an optional coupler and configured to retain a support wall portion and a connecting wall portion in a desired orientation relative to one another and an optional stop arrangement configured to limit displacement of the base member relative to the support wall.

FIG. 12*a* illustrates the base and an intermediate position relative to the support wall. FIG. 12*b* illustrates the base in a lowermost position relative to the support wall, with a lower stop surface acting as a limit stop of the base relative to the support wall. FIG. 12*c* illustrates the base in an uppermost position relative to the support wall, with an upper stop surface acting as a limit stop of the base relative to the support wall.

FIG. 13 also illustrates an optional feature of the illustrated embodiment in which portions of the base member may flex relative to one another.

DETAILED DESCRIPTION OF THE PREFERRED EMBODIMENT

An improved package assembly is disclosed herein. The package assembly includes an improved structure which provides new alternatives to known suspension packaging systems.

In the following detailed description, terms of orientation such as "upper," "lower," "longitudinal," "horizontal," "vertical," "lateral," "midpoint" and "end" are used herein to simplify the description in the context of the illustrated embodiments. Because other orientations are possible, however, the present invention should not be limited to the illustrated orientations. Additionally, the term suspension is not intended to require that anything, such as an article to be packaged, is suspended above anything. Rather, the term suspended as used herein, is only intended to reflect that such an article is held in a position spaced from another member, such as at least one of the walls of a container or box. Those skilled in the art will appreciate that other orientations of various components described herein are possible.

Figure 1:
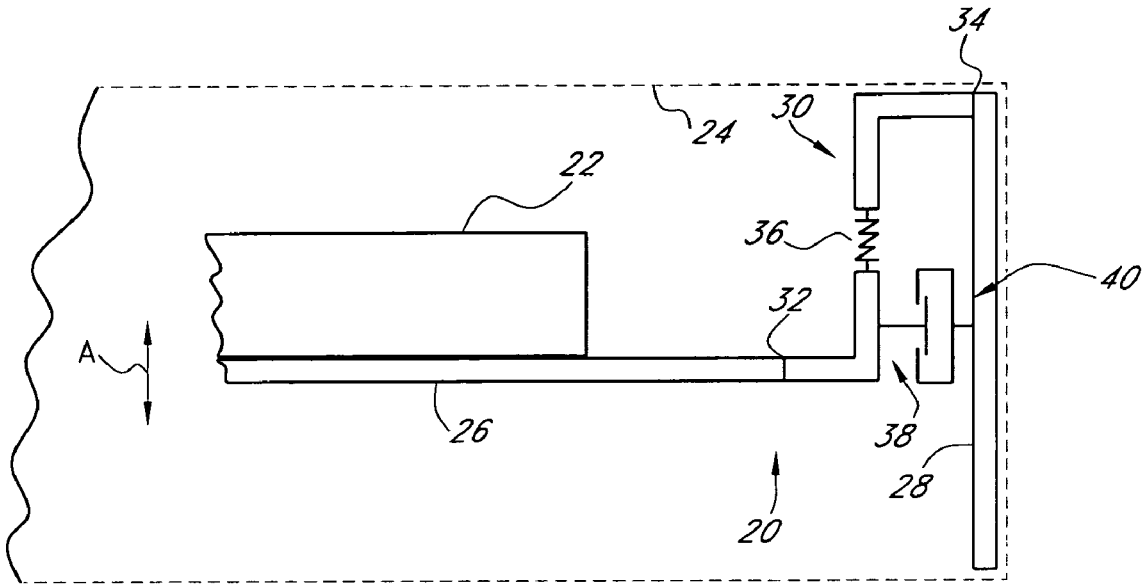
FIG. 1 is a schematic view of a packaging member including a base, a wall, and a connecting portion connecting the base and the wall. The connecting portion is configured to permit displacement of the base relative to the wall. The suspension-packaging member may be placed within a box, as illustrated by the phantom line in FIG. 1.

FIG. 1 is a schematic illustration of a packaging member 20 which is constructed in accordance with an embodiment. The packaging member 20 preferably is configured to support an article 22. Optionally, the packaging member 20 and the article 22 may be positioned within a container, such as a box 24, for example. Generally, the packaging member 20 includes a base 26, a lateral wall 28 and a connector 30, which connects the base 26 to the lateral wall 28. A junction 32 between the base 26 and the connector 30 and a junction 34 between the connector 30 and the lateral wall 28 preferably are configured such that the base 26 and lateral wall 28 are pivotable, or foldable relative to the connector 30. If the packaging member 20 is constructed from cardboard, or a similar material, the junctions 32, 34 may be defined by fold lines, scores, or perforations in the material, or other similar or suitable structures, including mechanical fasteners, for example.

Preferably, the connector 30 is configured to permit the base 26 to move relative to the lateral wall 28. In some arrangements, the base 26 is configured to move in a direction generally parallel to the lateral wall 28, or generally perpendicular with respect to a surface on which the packaging member 20 is supported, as illustrated by the arrow A in FIG. 1. In the orientation illustrated in FIG. 1, movement of the base 26 is in a generally vertical direction. However, movement of the base 26 may by in other directions in other arrangements of the packaging member 20.

In the illustrated arrangement, the connector 30 is configured to support the base 26 in a relaxed, or normal, position relative to the lateral wall 28. In the relaxed position, the base 26 may be at any vertical location relative to the lateral wall 28. The connector 30 may be configured to take into account the weight of the article 22 such that the relaxed position of the base 26 is at a desired location, or within a desired range, relative to the lateral wall 28. Desirably, the base 26 is movable in at least one direction from the relaxed position and, preferably, in a direction generally parallel to the lateral wall 28.

The connector 30 is configured to provide a spring force, as represented by the spring element 36, which produces a resistance force in response to movement of the base 26 from the relaxed position and, preferably, tends to move the base 26 towards the relaxed position. Thus, advantageously, the base 26 (and article 22) may move at least along the direction of the arrow A in response to forces applied to the packaging member 20 and, specifically, the lateral wall 28 such that the external forces are attenuated prior to reaching the article 22. If the packaging member 20 is positioned within a container 24, desirably, the lateral wall 28 contacts one or more surfaces of the container 24 and the base 26 is spaced from one or more walls of the container. Accordingly, external forces apply to the container 24 act directly on the lateral wall 28 and such forces are attenuated by the connector 30 prior to reaching the base 26, and the article 22. As a result, damage to the article 22 may be inhibited.

The spring force produced by the spring element 36 may be varied depending upon the desired application. In some embodiments, the spring force may be relatively slight, and may not be sufficient to move lift the base 26 and article 22 once the base 26 has moved in a downward direction. In other embodiments, the spring force may take into account the weight of the article(s) to be packaged, and may be sufficient to lift the base 26 and article 22 relative to the wall 28 toward a relaxed position.

In some arrangements, the packaging member 20 may include a coupler 38, which is configured to maintain a desired orientation between the base 26 and the lateral wall 28. In the illustrated arrangement, the coupler 38 inhibits the base 26 from moving in a direction perpendicular to the lateral wall 28. In addition, the coupler 38 preferably inhibits movement of the base 26 relative to the lateral wall 28 except for in the direction of the arrow A, which preferably is generally parallel to the wall 28 and vertical in the illustrated orientation.

In one embodiment, the packaging member 20 includes a stop arrangement 40, which is configured to limit the magnitude of movement of the base 26 in at least one direction relative to the lateral wall 28. That is, the stop arrangement 40 may have an upper stop surface configured to contact a surface movable with the base 26 to limit the upward movement (in the orientation of FIG. 1) of the base 26 relative to the lateral wall 28. In other arrangements, the stop 40 may include a lower stop surface configured to contact a surface movable with the base 26 to limit downward movement of the base 26 relative to the lateral wall 28. Preferably, the stop 40 is configured to limit both upward and downward movement of the base 26 relative to the lateral wall 28.

In the illustrated arrangement, the coupler 38 and the stop 40 are integrated. However, in other arrangements, the coupler 38 and the stop 40 may be formed separately, in instances in which both are present.

Figure 2:
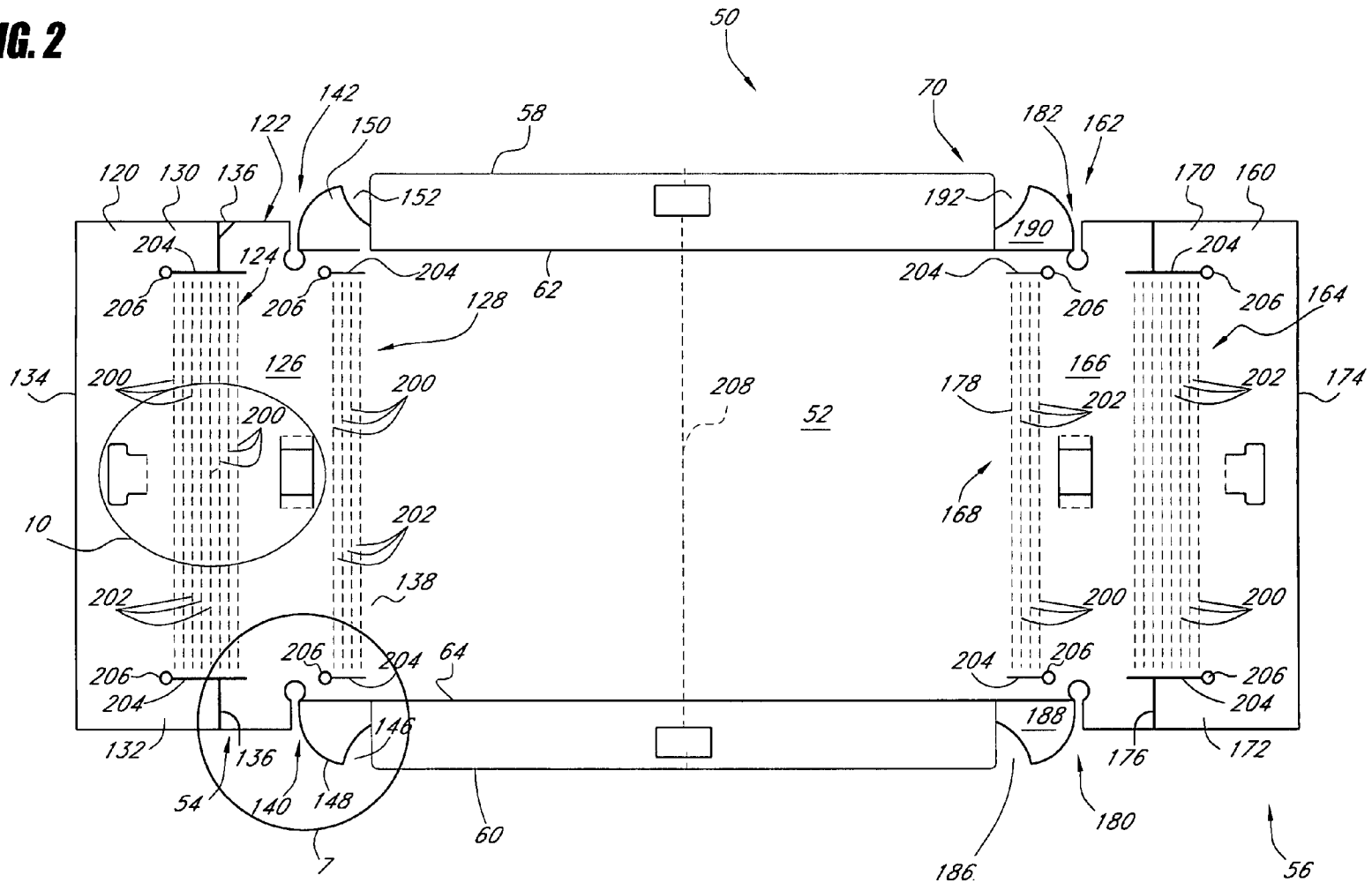
FIG. 2 is a plan view of a packaging member in an unfolded state, the packaging member having foldable portions disposed around a periphery of a central base member.

With reference to FIG. 2, a packaging member 50 is illustrated in an unfolded state and is constructed in accordance with another embodiment. Generally, the packaging member 50 includes a base member 52 and a pair of foldable portions 54, 56. In the illustrated arrangement, the foldable portions 54, 56 are located on opposing sides of the base member 52. The base member 52 is configured to engage or provide support for one or more articles to be packaged.

Figure 8:
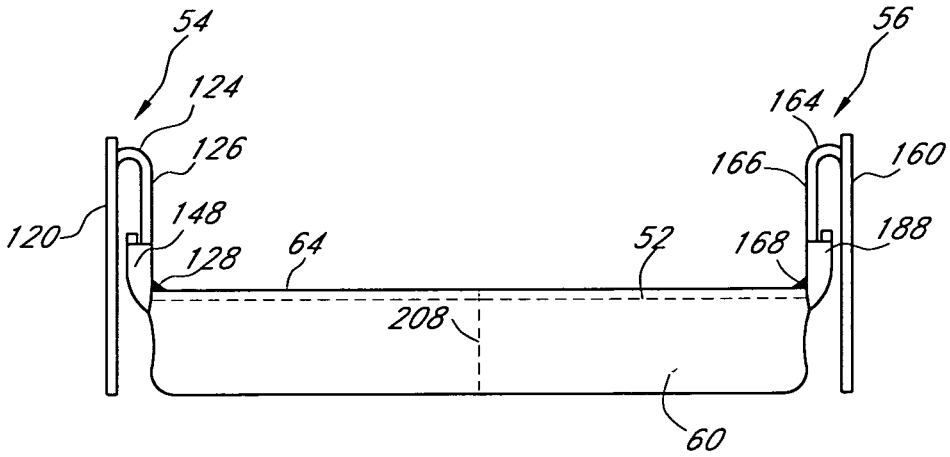
FIG. 8 is a side elevational view of the packaging member of FIG. 2 in a folded configuration.
Figure 9:
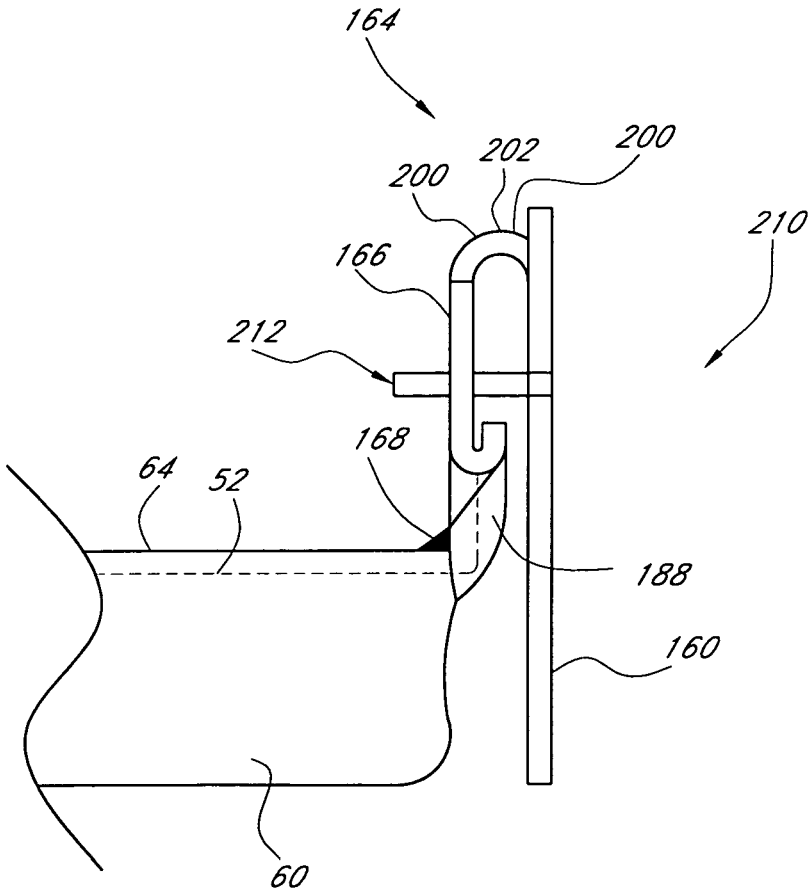
FIG. 9 is a side elevational view of one support wall and a portion of the base member of the packaging member of FIG. 8.
Figure 13:
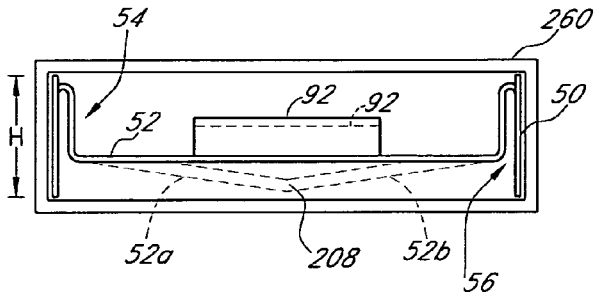
FIG. 13 is a side elevational view of the package assembly of FIG. 4 in a folded position and enclosed within a container.

Preferably, the foldable portions 54, 56 may be manipulated to form lateral sidewalls that suspend the base member 52 (see FIGS. 8 and 13). The foldable portions 54, 56 may be configured to extend generally vertically on either side of the base member 52 when in the folded orientation, as is described in greater detail below.

In some embodiments, the packaging member 50 also includes foldable portions 58, 60, which are configured to increase a tension in a resilient member (FIG. 3) for holding one or more articles in a desired position relative to the base member 52. An exemplary position of the placement of the article on the base member 52 is shown in FIG. 4.

The packaging member 50 may be constructed from various materials, including but without limitation, pulp, paper, cardboard, corrugated cardboard, plastic, combinations thereof, and other appropriate materials. The chosen material for constructing the packaging member 50 may be any substantially rigid but foldable material. It will be appreciated that, although denominated as rigid or substantially rigid, the chosen material would preferably have an amount of flexibility in the event of extreme physical impact. In some embodiments, the material used to form the packaging member 50 is a single wall corrugated C-flute cardboard. The illustrated packaging member 50 is a generally thin, planar member; however, the packaging member 50 may have other configurations as well.

The base member 52 may be sized and dimensioned so as to engage or provide support for one or more articles. Although the base member 52 is described primarily as being disposed at the center of the packaging member 50, the base member 52 may be at other locations. Additionally, the base member 52 may comprise a plurality of members, each configured to engage an article. For the sake of convenience, the base member 52 is described as a generally planar, centrally-disposed member.

The size of the base member 52, which defines a loading area, can be chosen arbitrarily or to accommodate, support, or engage an article, or articles, of a particular size. The loading area size can be chosen based on the number and configuration of the articles on or proximate to the base member 52. In some non-limiting exemplary embodiments, the base member 52 may be used to package one or more communication devices (e.g., portable telephones, cellular telephones, radios, headsets, microphones, etc.), electronic devices and components (e.g., laptop computers), accessories (e.g., cellular telephone covers), storage devices (e.g., disk drives), and the like. In certain embodiments, the base member 52 is configured to package one or more portable digital media players, such as IPODS® or MP3 players, for example.

It is contemplated that the base member 52 can be designed to package any number and type of articles. In the illustrated embodiment, the base member 52 is somewhat square shaped and has a surface area (i.e., the loading area) of about 40-400 inches square. In some non-limiting embodiments, the base member 52 has a loading area more than about 40 inches square, 100 inches square, 200 inches square, 300 inches square, 400 inches square and ranges encompassing such areas. However, these are merely exemplary embodiments, and the base member 52 may have other dimensions for use in communication devices, packaging modems, hard drives, portable telephones, or any other article that is to be packaged.

The illustrated base member 52 has a generally flat upper surface that an article may rest against. Other non-limiting base members can have mounting structures, apertures, recesses, partitions, separators, or other suitable structures for separating articles or inhibiting movement of an article engaging the base member 52. For example, the base member 52 may have at least one holder that is sized and configured to receive an article.

Desirably, the foldable portions 58, 60 are configured to cooperate with a resilient member to secure an article in a desired position on the base member 52. The foldable portion 58 may be folded downwardly (relative it the orientation shown in FIG. 2) about a fold line 62 towards a bottom surface of the base member 52. When the foldable portion 58 is folded, it may be approximately parallel to the base member 52. In some embodiments, the foldable portion 58 may lie against the base member 52. The foldable portion 60 may be folded in a similar manner about a fold line 64. Thus, the foldable portions 58, 60 may be folded along the fold lines 62, 64, respectively, toward the bottom surface of the base member 52.

The fold lines 62, 64 may be formed as perforations in the packaging member 50, i.e., broken cut lines passing partially or completely through the material forming the packaging member 50. In the alternative, or in addition, the fold lines 62, 64 may be crushed portions of the material forming the member 50. Of course, depending upon the material used to construct the packaging member 50, the fold lines 62, 64 may be formed as mechanical hinges, thinned portions, adhesive tape or any other appropriate mechanical connection which would allow various portions of the foldable member to be folded or rotated with respect to each other. These concepts apply to all the fold lines described herein, even though this description may not be repeated with respect to other specific fold lines described below.

In some embodiments, each foldable portion 58, 60 is configured to fit into a corresponding pocket of a resilient member. The foldable portions 58, 60 are configured to securely hold and tension the resilient member by folding the foldable portions 58, 60 along the fold lines 62, 64, as described in greater detail below. The foldable portions 58, 60 preferably cooperate to tension the resilient member so as to resiliently support one or more articles against the base member 52.

Figure 3:
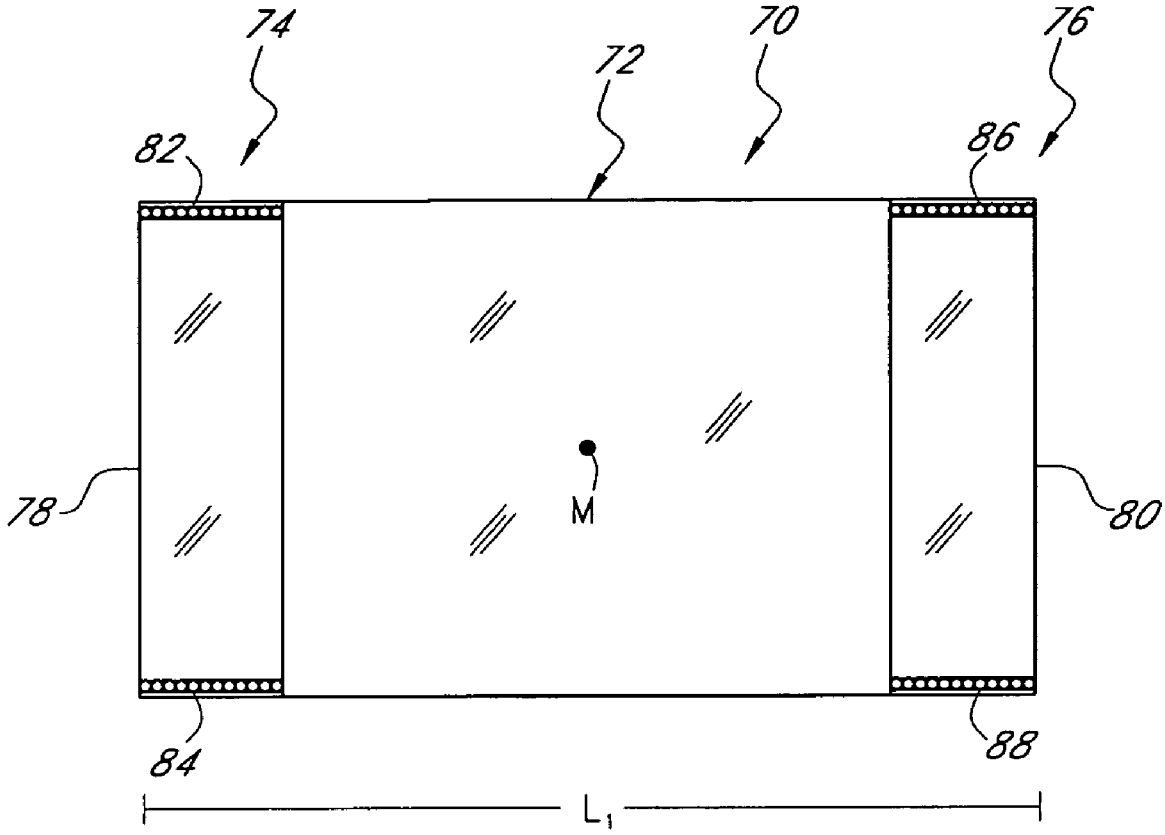
FIG. 3 is a plan view of retention member having a pair of opposing pockets.
Figure 4:
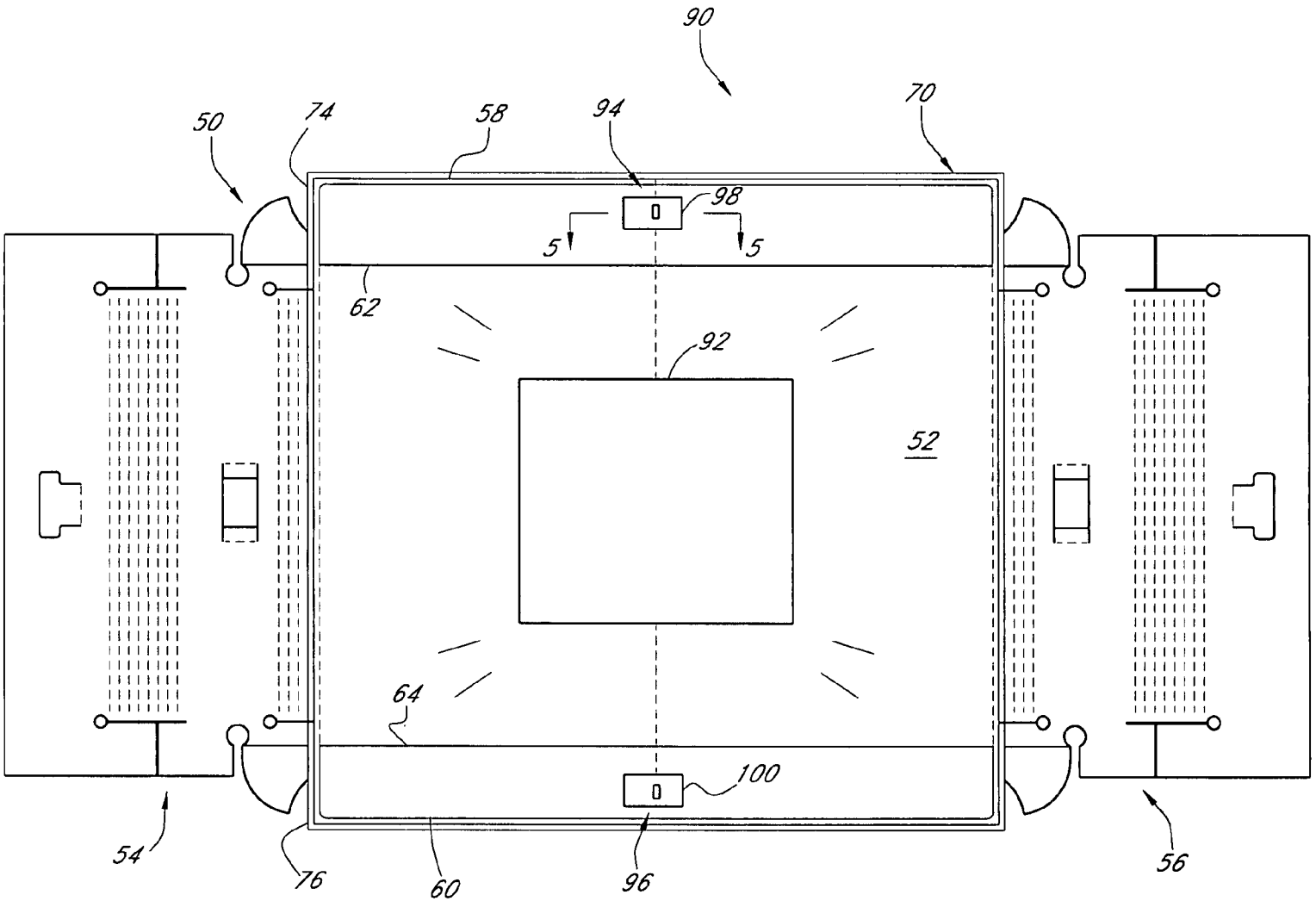
FIG. 4 is a top plan view of a package assembly having the retention member attached to the packaging member. The package assembly is in an unfolded state with an article disposed between a surface of the retention member and a surface of the packaging member.

With reference to FIG. 3, the resilient member in the illustrated embodiment is identified as a retention member 70. The retention member 70 preferably is formed of a resilient body 72. For the purpose of convenience for the following description, the body 72 is identified as having a mid-point M positioned in the vicinity of the middle of the resilient body 72. The resilient body 72 also includes pockets 74, 76 at opposite ends thereof. In the illustrated embodiment, the retention member 70 is formed of a single piece of resilient material, and is sized to cooperate with the foldable portions 58, 60 of the packaging member 50.

In the illustrated embodiment, the pockets 74, 76 are formed of folds 78, 80 formed in the resilient body 72, which have been attached (e.g., heat sealed, bonded, fused, welded, etc.) along lateral opposite edges thereof. In this embodiment, a heat sealing process forms the heat sealing lines 82, 84, 86, 88. The heat sealing lines 82, 84, 86, 88 may be continuous or formed of a plurality of heat sealed points or sections.

One of ordinary skill in the art will appreciate that there are numerous methods for forming pockets in a resilient sheet material such as the resilient body 72. However, it has been found that heat sealing is particularly advantageous as it does not require expensive adhesives and the time-consuming steps required for using such adhesives. However, such adhesives can be used if desired. Welding processes (e.g., induction welding), fusing techniques, and the like can also be used to form the lines 82, 84, 86, 88.

The retention member 70 has a length $L_1$ that is sized depending on the other devices with which the retention member 70 is to cooperate. Thus, the length $L_1$ can be sized such that when the retention member 70 is in its final state, e.g., engaged with the foldable portions 58, 60, it generates the desired tension for the corresponding application. Thus, the length $L_1$ generally will be smaller where a higher tension is desired and will be larger where a lower tension is desired. Additionally, the length $L_1$ might be different for different sized articles that are to be packaged. One of ordinary skill in the art will be able to determine an appropriate length $L_1$ for the corresponding application in view of the disclosure herein.

The retention member 70 may be formed of any resilient material. In some embodiments, the retention member 70 is made of a polyethylene film. However, virtually any polymer, elastomer, or plastic film may be used to form the retention member 70. The density of the film may be varied to provide the desired retention characteristics such as overall strength, resiliency, and vibrational response. Preferably, the density of the retention member 70 is determined such that the retention member 70 is substantially resilient when used to package a desired article. The retention member 70 may be a monolayer or a multi-layer sheet depending on the application.

Figure 6:
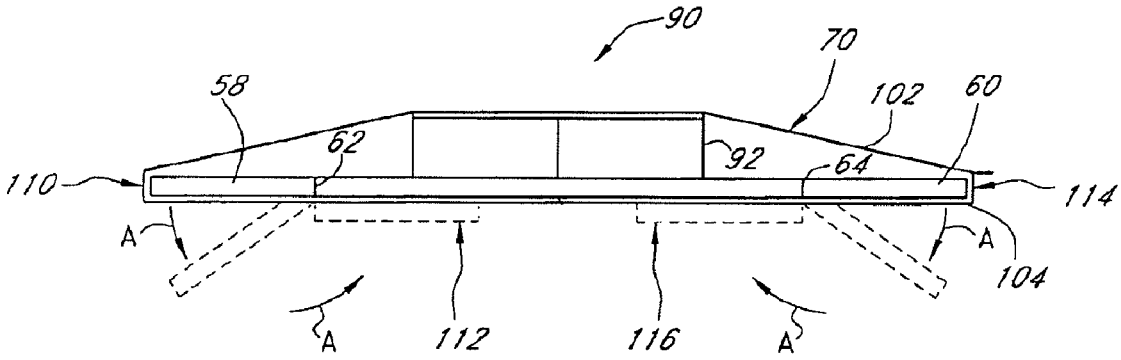
FIG. 6 is a side elevational view of the package assembly and an article held therein. Foldable portions of the packaging member which engage the retention member are illustrated moving between an unfolded position and a folded position, with certain positions of the foldable portions shown in phantom.

With reference to FIG. 4, a suspension package assembly 90 includes the packaging member 50 and the retention member 70 connected thereto. An article 92 is securely held between the retention member 70 and the base member 52 of the packaging member 50 (FIG. 6). In some arrangements, the retention member 70 may be permanently mounted to the packaging member 50, as is described below.

In the illustrated assembly 90, the foldable portions 58, 60 are positioned within the corresponding pockets 74, 76. The length between outer edges (i.e., the length of the packaging member 50) of the foldable portions 58, 60 may be slightly greater than the length $L_1$ of the retention member 70. The article 92 may be inserted between the retention member 70 and the base 52 after the retention member 70 is mounted to the packaging member 50.

The assembly 90 may include at least one coupling structure configured to aid in keeping the retention member 70 connected to the packaging member 50. In some embodiments, the packaging member 50 may include one or more coupling structures (e.g., 94, 96) configured to inhibit movement between the retention member 70 and the packaging member 50 and, more specifically, to inhibit the foldable portions 58, 60 from being removed from the pockets 74, 76, respectively, of the retention member 70.

Each of the coupling structures 94, 96 may include at least one mounting aperture for receiving at least a portion of the retention member 70. The mounting portions for example, the foldable portions 58, 60 may include at least one aperture 98, 100, which form at least a portion of the coupling structure 94, 96. The mounting apertures 98, 100 are configured to accommodate a coupler that is configured to inhibit relative movement of the retention member 70 with respect to the packaging member 50. The illustrated coupling structures 94, 96 include a single aperture 98, 100, respectively.

Figure 5:
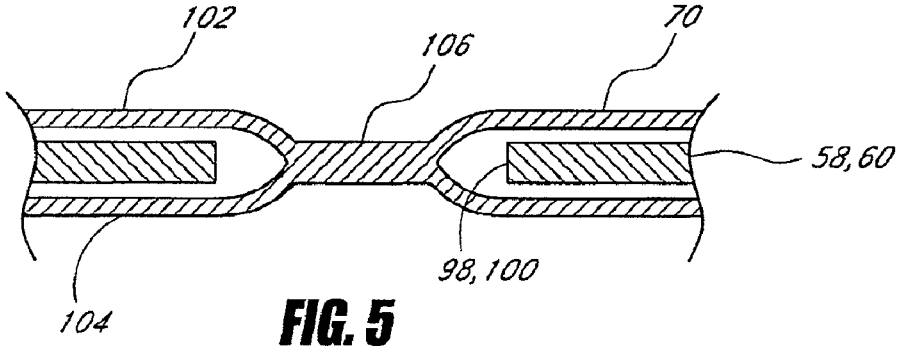
FIG. 5 is a cross-sectional view of an optional feature of the package assembly of FIG. 4 taken along the line 5-5 in FIG. 4.

As shown in FIG. 5, when the pockets 74, 76 of the retention member 70 are engaged with the foldable portions 58, 60 of the packaging member 50, parts of the pockets 74, 76 are disposed on opposite sides (e.g., upper and lower sides) of the foldable portions 58, 60. In this arrangement, the retention member 70 includes a first sheet 102 and a second sheet 104 on opposite sides of the corresponding foldable portion 58 or 60.

In other words, a portion of the packaging member 50 that defines the aperture 98 or 100, in this case, the foldable portions 58, 60, is positioned between the first sheet 102 and the second sheet 104. A coupler 106 of the coupling assembly 94 or 96 connects the first sheet 102 with the second sheet 104, and is positioned within the aperture 98 or 100. Such an arrangement provides a further advantage in securing the retention member 70 to the packaging member 50. As such, the complete assembly 90 may be shipped to a customer, with the retention member 70 securely connected to the packaging member 50, thereby avoiding the need for the end customer to assemble the packaging member 50 and the retention member 70.

In some embodiments, the coupler 106 may be in the form of a heat seal that cooperates with the aperture 98 or 100 to limit movement of the retention member 70. The heat seal 106 may be formed by a heat sealing process, thermal bonding, fusion, adhesives, and the like. In some embodiments, the heat seals are formed from the material forming the sheets 102, 104.

The heat seal 106 may include one or more heat sealing lines, heat sealed points, or other types of a coupling structure. The illustrated heat seal 106 is positioned within the aperture 98 or 100. A skilled artisan will be able to select an appropriately sized heat seal 106 to fit within the aperture 98 or 100, while maintaining the desired strength of the bond between the first sheet 102 and the second sheet 104 during the assembly of the package assembly 90.

Other configurations may also be employed to inhibit movement of the retention member 70 with respect to the packaging member 50. Mechanical fasteners, snaps, closures, or other structures may be used to couple the retention member 70 to the packaging member 50. Such alternative structures may be used alone or in combination with heat seals and/or apertures. For example, the coupling assemblies 94, 96 may be in the form of fasteners that pass through the packaging member 50, with or without the provision of pre-formed apertures 98, 100. That is, such fasteners may be utilized to form the aperture as the fastener passes through the material from which the packaging member 50 is constructed.

Heat sealing, however, provides yet a further improvement because heat sealing is easily incorporated into manufacturing lines for corrugated cardboard. For example, as raw corrugated cardboard pieces are moved along an assembly line, in which dies are used to cut the raw cardboard into the desired shapes, such a packaging member 50, a retention member, such as the retention member 70, may be placed on the packing member 50 and heat sealed to it with heat sealing devices. A number of such finished assemblies 90 may then be packaged in a box or container and shipped to the customer with little or no human labor.

In some embodiments, with reference to FIG. 5, the apertures 98, 100 are positioned in the folding portions 58, 60. However, the apertures 98, 100 may be at other locations. Additionally, any number of apertures 98, 100 may be utilized. For example, a plurality of apertures 98, 100 may be positioned at various points along the foldable portions 58, 60. In some embodiments, the foldable portions 58, 60 each have at least two apertures 98, 100. Each of the apertures 98, 100 preferably interacts with at least one heat seal or other coupling structure.

The apertures 98, 100 may have any suitable shape for receiving a heat seal, or other coupling structure. The illustrated apertures 98, 100 are somewhat rectangular in shape. In alternative arrangements, however, the apertures 98, 100 may be circular, elliptical, polygonal (including rounded polygonal) or other shapes, as desired.

Utilizing the coupling assemblies 94, 96, the retention member 70 remains retained to the packaging member 50 even when the packaging member 50 is manipulated. As such, the retention member 70 may be secured to the packaging member 50 before or after the article 92 is positioned between the retention member 70 and the packaging member 50. Additionally, the retention member 70 remains coupled to the packaging member 50 during, e.g., transportation of the assembled suspension package assembly 90.

The package assembly 90 may be folded from the illustrated, generally flat configuration of FIG. 4 to tension the retention member 70. FIG. 6 illustrates the foldable portions 58, 60 being folded downwardly along the folding lines 62, 64, respectively, thereby tensioning the retention member 70. The coupling assemblies 94, 96 (not shown in FIG. 6) hold the resilient member 70 to the packaging member 50 as the foldable portions 58, 60 are folded.

The foldable portion 58 may be rotated in the direction indicated by the arrows A of FIG. 6 from an unfolded position 110 to a folded position 112. Similarly, the foldable portion 60 may be rotated in the direction of the arrows A in FIG. 6 from an unfolded position 114 to a folded position 116. The folded positions 112, 106 may be the maximum limit of rotation of the foldable portions 58, 60 or, if desired, a position that is less than the maximum limit of rotation. Such a position may be defined by the length or resiliency of the retention member 70, size of the article 92, among other factors.

With reference to FIG. 2, as described above, preferably the foldable portions 54, 56 are configured to be folded relative to the base 52 to create a pair of lateral support walls on opposing sides of the base 52. The support walls created by the foldable portions 54, 56 are configured to space the base 52 from a surface upon which the support walls may rest, such as a bottom wall of a container, for example. Preferably, the support walls are coupled to the base 52 through one or more compound joints, which are configured to permit the base 52 to move relative to the support walls and, preferably, in a direction generally parallel to the support walls.

The illustrated foldable portion 54 includes a first portion, or support wall portion 120, and a second portion, or connecting portion 122. As described above, at least one compound joint is interposed between the support wall 120 and the base 52. In the illustrated arrangement, a first compound joint 124 is positioned between the support wall 120 and a connecting wall portion 126 of the connecting portion 122. In addition, an optional second compound joint 128 may be positioned between the connecting wall portion 126 and the base member 52. Although such an arrangement is preferred, it is not necessary that both of the first compound joint 124 and second compound joint 128 are present in any particular embodiment of the packaging member 50. In addition, in some embodiments the connecting wall portion 126 may be omitted and the support wall portion 120 may be connected to the base member 52 through a single compound joint, such as either of the compound joints 124 or 128.

As described above, the foldable portions 54 and 56 are foldable relative to the base member 52 to create lateral support walls, which are configured to suspend the base member 52 from a surface upon which the support walls may rest. In particular, in the illustrated embodiment, the first compound joint 124 permits the support wall 120 to be rolled, folded, or pivoted downwardly (into the paper in FIG. 2) with respect to the connecting wall portion 126. Desirably, the support wall 120 may be folded to an orientation generally parallel with the connecting wall portion 126.

Furthermore, the second compound joint 128 permits the connecting wall portion 126 to be rolled, folded, or pivoted relative to the base member 52, preferably in an upward direction (out of the paper in FIG. 2). Desirably, the connecting wall portion 126 is pivotable into an orientation such that the connecting wall portion 126 is generally perpendicular to the base member 52. Accordingly, the support wall portion 120 and connecting wall portion 126, along with the first and second compound joints 124, 128 cooperate to define a lateral support wall configured to suspend the base member 52 and permit the base member to move relative to the support wall.

In the illustrated arrangement, the support wall portion 120 is generally rectangular, although other suitable shapes may also be used. An outwardly-facing edge 134 of the foldable portion 54 defines a lower edge of the support wall portion 120, when the support wall portion 120 is folded. The support wall portion 120 includes a pair of tabs 130, 132, which extend in an upward direction when the support wall portion 120 is folded. The tabs 130, 132 cooperate to define an upper edge of the support wall portion 120. In the illustrated arrangement, the upper edge is defined by a cut line 136 between the support wall portion 120 and the connecting wall portion 122. In the illustrated arrangement, the cut line 136 extends inwardly from outward edges of the foldable portion 54 to the compound joint 124.

Preferably, the upper edge 136 extends above the compound joint 124 when the support wall portion 120 is folded. Preferably, the upper edge 136 is spaced above an uppermost portion of the compound joint 124 when the base member 52 is in an uppermost position relative to the support wall portion 120. If desired, the distance between the lower edge 134 and the upper edge 136 may be configured to generally correspond with the height of a container in which the packaging member 50 is positioned to package one or more articles.

The connecting wall portion 126, in the illustrated embodiment, is also generally rectangular in shape. The cut line 136 also defines an upper edge of the connecting wall portion 126. A lower edge of the connecting wall portion is defined by a fold line 138 between the base member 52 and the foldable portion 54.

Figure 7:
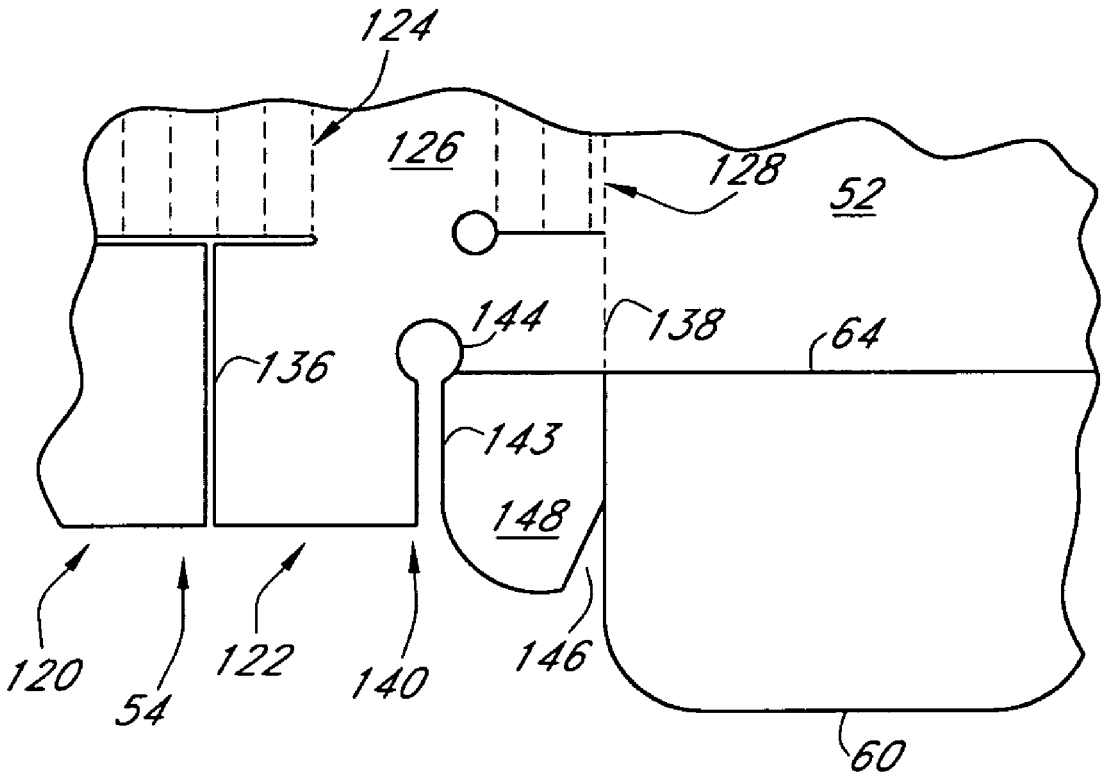
FIG. 7 is a plan view of a portion of the packaging member identified by the line 7 in FIG. 2.

With additional reference to FIG. 7, preferably each lateral end of the connecting portion 122 includes a keyhole slot 140, 142, respectively. The keyhole slot 140 is illustrated in FIG. 7, however, desirably each keyhole slot 140, 142 is of a substantially similar construction. The keyhole slot 140 includes a slot portion 142, which is substantially linear and extends inwardly from the outward edge of the connecting portion 122. The slot portion 142 terminates in a circular aperture 144. The aperture 144 is configured to reduce stress on the material from which the packaging member 50 is constructed to inhibit tearing of the material and may be referred to herein as a "tear stop." Desirably, the keyhole slot 140 is positioned generally at the midpoint of the height of the connecting wall portion 126.

In the illustrated arrangement, a generally triangular slot 146 extends inwardly from an outward edge of the packaging member 50 between the foldable portion 60 and the foldable portion 54. The triangular slot 146 may be configured to accommodate a pocket 78, 80 of the resilient member 70 of FIG. 3.

Preferably, the fold line 138 extends outwardly beyond the fold line 64 and terminates at the triangular slot 146. Similarly, the fold line 64 between the base member 52 and the foldable portion 60 extends outwardly beyond the fold line 138, through the foldable portion 54, and terminates at the keyhole slot 140. Thus, ends of the fold lines 64 and 138, along with the keyhole slot 140, define a tab 148 that is foldable relative to the remainder of the connecting portion 122 and foldable portion 60. The tab 148 may be folded and positioned between the connecting wall portion 126 and the support wall portion 120 when the folding portion 54 is folded to create a support wall, as illustrated in FIG. 8.

Preferably, the opposing end of the connecting portion 122 is substantially similar to that described immediately above. In particular, preferably the fold lines 138 and 62, along with the keyhole slot 142 cooperate to define a tab 150, similar to the tab 148. In addition, a generally triangular slot 152 is defined between the foldable portion 58 and the foldable portion 54 and is intersected by the fold line 138.

In the illustrated arrangement, the foldable portion 56 is configured to be a mirror image of the foldable portion 54. That is, desirably the foldable portion 56 includes a support wall portion 160 and a connecting portion 162. A first compound joint 164 connects the support wall portion 160 with the connecting portion 162. The connecting portion 162 includes a connecting wall portion 166 separated from the base member 52 by a second compound joint 168.

The support wall portion 160 includes first and second tabs 170, 172. The support wall portion 160 also includes a lower edge 174 defined by an outward edge of the foldable portion 56 and an upper edge defined by a cut line 176.

In a manner similar to the foldable portion 54, the support wall portion 160 may be folded downwardly relative to the connecting portion 162. Furthermore, the connecting wall portion 166 may be folded relative to the base member 52 in an upward direction along a fold line 178. Thus, the foldable portion 56 may be folded into a support wall which permits movement of the base 52 relative to the support wall.

Desirably, a foldable portion 56 also includes keyhole slots 180 and 182, which are substantially similar to the keyhole slots 140 and 142. A generally triangular slot 186 extends inwardly from an outer edge of the packaging member 50 between the foldable portion 60 and the foldable portion 56. In addition, the fold line 178, fold line 64 and the keyhole slot 180 cooperate to define a tab 188 of the connecting portion 162.

On the opposing side of the connecting portion 162, the fold lines 62 and 178, along with the keyhole slot 182, define a tab 190 of the connecting portion 162. A triangular slot 192 extends inwardly from an outward edge of the packaging member 50 between the foldable portion 56 and the foldable portion 58. Preferably, the fold line 178 terminates at the triangular slot 192. Accordingly, the tabs 188 and 190 may be folded relative to the remainder of the connecting portion 162 so as to be positioned between the connecting wall portion 166 and the support wall portion 160 when the foldable portion 56 is folded relative to the base member 52 into a support wall.

In the illustrated arrangement, the compound joints 124, 128, 164, 168 are defined by a plurality of fold lines 200 which themselves define a plurality of relatively less rigid portions and cooperate to define a plurality of relatively more rigid sections 202 between them. Desirably, the fold lines 200 are generally parallel to one another and parallel to the fold lines 138 and 178, which separate the base member 52 from the foldable portions 54 and 56, respectively. Thus, the sections 202 are generally rectangular, elongate portions of material between the fold lines 200. Desirably, the sections 202 extend along a substantial length of the foldable portions 54 and 56. However, in the illustrated arrangement, each of the compound joints 124, 128, 164, 168 have a length that is slightly less than the length of the foldable portions 54, 56. The ends of each compound joint 124, 128, 164, 168 are bounded by cut lines 204. The upper end of each cut line 204 preferably terminates in a circular aperture, or tear stop 206. Although such compound joints 124, 128, 164, 168 are preferred, other suitable arrangement or structures may also be used.

In the illustrated packaging member 50, the fold lines 200 of the compound joints 124, 128, 164, 168 are constructed of intermittent or broken cut lines passing partially or completely through the material forming the packaging member 50. With such an arrangement, the compound joints 124, 128, 164, 168, when folded, tend to want to return to a planar orientation. Accordingly, the compound joints 124 and 164 produce a spring force tending to lift the base member 52 in an upward direction relative to the support wall. Thus, the compound joints 124, 128, 164 and 168 can be configured to support the base member 52 (and any articles supported thereon) in a desired "relaxed" position relative to the support walls, but permit movement of the base member 52 relative to the support walls in response to forces imparted to the packaging member 50. Preferably, movement of the base member 52 is permitted in upward and downward directions.

The compound joints 124 and 164 may be configured to move the base member 52 upwardly, toward the relaxed position, after the base member 52 has moved in a downward direction from, for example, a force imparted on the packaging member 50. The weight of the articles supported on the base member 52 may tend to move the base member 52 toward the relaxed position after the base member 52 has moved in an upward direction from, for example, a force imparted on the packaging member 50. Thus, the compound joints 124, 128, 164, 168 may be configured to provide a resistance force to downward movement of the base member 52, taking into account the weight of the articles to be packaged, such that the base member 52 moves to a desired relaxed position when loaded. For example, factors to consider in configuring the compound joints 124, 128, 164, 168 may include the material from which the packaging member 50 is constructed, the number of fold lines 200 and rigid sections 202 within each joint 124, 128, 164, 168, the size of the rigid sections 202, the size and/or spacing of the cut portions of the fold lines 200 or the type of fold line 200, for example. Those skilled in the art will be able to determine other factors in configuring the compound joints 124, 128, 164, 168 for a particular application.

The relaxed position may vary for any particular packaging member 50, even under the same or similar loading conditions, due to variations in the material from which the packaging member 50 is constructed or variations in the creation of the fold lines 200, for example. In some non-limiting embodiments, the lower surface of the base member 52 is spaced from the surface upon which the packaging member 50 is supported by about 0.1 inch, 0.2 inch, 0.25 inch, 0.3 inch, 0.5 inch, 0.75 inch, and ranges encompassing such lengths. However, in other arrangement, other spacing may be desired. For example, in some arrangements, the article(s) may be positioned about in the center of a container in which the packaging member 50 is placed.

With reference to FIGS. 2 and 8, desirably a fold line 208 extends through the base member and, preferably, through the foldable portions 58 and 60. Desirably, the fold line 208 extends in a direction generally parallel to the fold lines 138 and 178, or parallel to the support walls defined by the foldable portions 54 and 56. Preferably, the fold line 208 is located at substantially the midpoint of the base member 52 between the foldable portions 54 and 56. With such a construction, relative movement between the portions of the base member 52 on opposing sides of the fold line 208 is permitted to add an additional degree of cushioning to an article supported by the packaging member 50.

With additional reference to FIGS. 9-12, desirably each of the foldable portions 54 and 56 include a coupling arrangement 210 which is configured to retain the support wall portion 120 or 160 in a desired position relative to the connecting portion 126 or 166. In the illustrated arrangement, the coupling assembly 210 is configured to maintain the support wall portions 120, 160 and the connecting wall portions 126, 166 in a generally parallel configuration. The coupling assemblies 210 preferably are substantially identical in structure and, therefore, only one of the assemblies 210 is described in detail.

Figure 10:
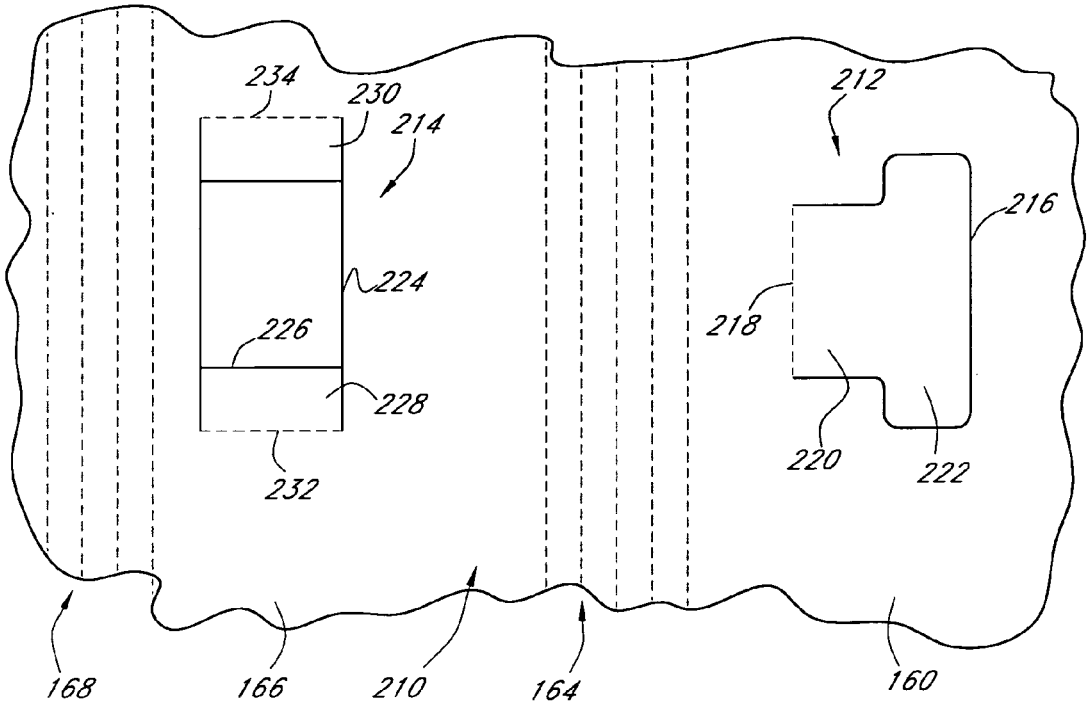
FIG. 10 is a plan view of a portion of the packaging member of FIG. 2 identified by the line 10 in FIG. 2.
Figure 11A:
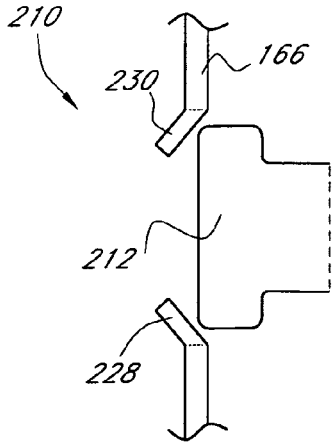
FIGS. 11*a* and 11*b* illustrate the insertion of a tab of the coupler into a slot of the coupler of FIG. 10.
Figure 11B:
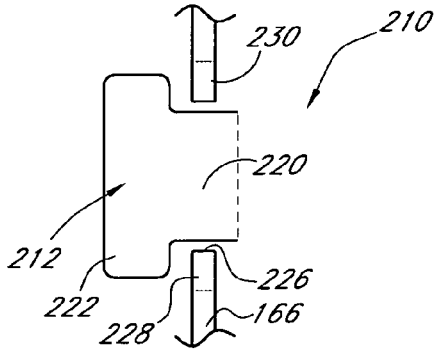
Figure 12A:
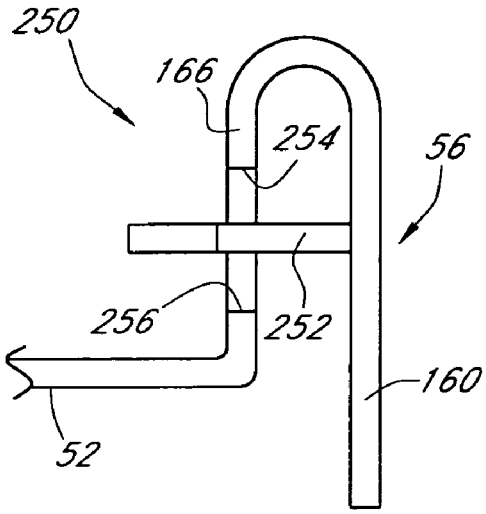
FIGS. 12*a*-12*c* are side elevational views of the packaging member of FIG. 8 in various relative positions of the base and the support wall.
Figure 12B:
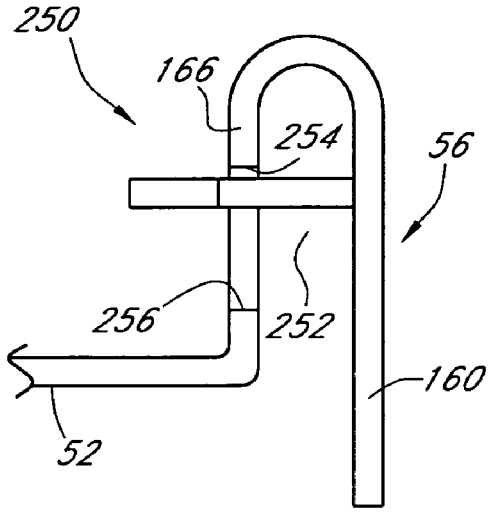
Figure 12C:
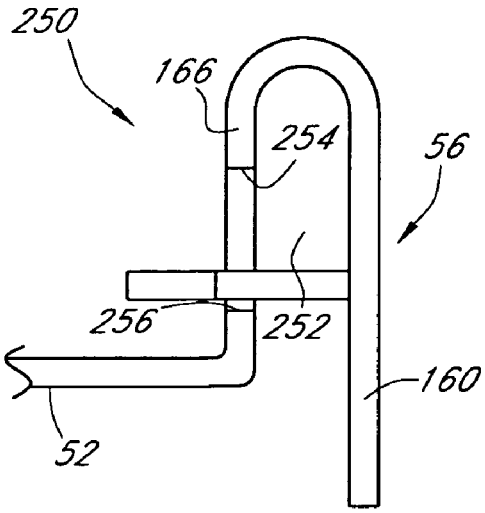

In one embodiment, the coupling assembly 210 includes a coupler constructed from a tab 212 and a slot, or opening 214. With reference to FIG. 10, the tab 212 is defined by a cut line 216, which defines an outline of the tab 212, and a fold line 218, which permits the tab 212 to be folded relative to the foldable portion 54 or 56, and specifically the support wall portion 120 or 160. The tab 212 includes a base portion, or shaft 220, and a head portion 222 which is larger than the shaft 220 in a lateral dimension.

The opening 214 is sized to receive the shaft 220 of the tab 212 and permit the shaft 220 to move within the opening 214. In the illustrated arrangement, the opening 214 is defined by a cut line 224, which defines a generally rectangular aperture 226. On opposing lateral sides of the aperture 226 a pair of tabs 228, 230 are configured to be foldable relative to the foldable portions 54, 56 along fold lines 232, 234. Preferably, the opening 214 is located on the connecting wall portions 126, 166. The fold lines 232, 234 are spaced from one another a distance generally equal to or slightly larger than a lateral width of the head 222 of the tab 212. Thus, the tabs 228, 230 may fold outwardly to permit the head 222 of the tab 212 to pass through the opening 214. Preferably, the tabs 228, 230 then return to their relaxed positions (i.e., aligned with the remainder of the foldable portions 54 or 56) such that removal of the tab 212 from the opening 214 is inhibited. In other arrangements, however, the tabs 228, 230 may be omitted and the tab 212 may be bent or otherwise manipulated to fit through the aperture 226.

The illustrated packaging member 50 also includes a stop arrangement 250 associated with each of the foldable portions 54, 56. The stop arrangement 250 is configured to limit movement of the base member 52 relative to the support walls defined by the foldable portions 54 and 56 in at least one direction. Desirably, the stop arrangement 250 limits relative movement of the base member 52 upward and downward directions relative to the support walls defined by the foldable portions 54 and 56. In the illustrated arrangement, the stop arrangement 250 includes a stop 252, which is configured to engage a first stop surface 254 to limit movement of the base member 52 in a first direction and, optionally, engage a second stop surface 256 to limit movement of the base member 52 in a second direction. In the illustrated arrangement, the stop arrangement 250 is defined by the tab 212 and opening 214 of the coupling assembly 210. Thus, the height of the opening 214 determines the total possible distance of movement, or travel, of the base member 52 relative to the support walls. However, in other arrangements, the coupling assembly 210 and stop arrangement 250 may be wholly or partially defined by separate structures.

With reference to FIG. 13, as discussed above, the packaging member 50 may be utilized to package an article 92 within a container, such as a box 260, for example. As described previously, the support walls of the packaging member 50, formed by the foldable portions 54 and 56, may be sized to generally correspond to a dimension of an interior of the box 260. In the illustrated arrangement, the height of the support walls of the packaging member 50 generally corresponds to the height H of the interior of the box 260.

Furthermore, the packaging member 50 is configured to support the article 92 in a position spaced from one or more walls of the box 260. In the illustrated arrangement, the packaging member 50 supports the article 92 in a position spaced from all of the walls of the box 260. As described previously, the lateral support walls formed by the foldable portions 54 and 56, permit displacement of the base member 52 (and article 92) relative to the support walls and, preferably, in a direction generally parallel to the support walls. Thus, the base member 52 (and article 92) may move relative to the support walls and the box 260 in response to external forces imparted on the box 260. Accordingly, damage to the article 92 may be inhibited.

In one embodiment, the fold line 208 (FIG. 2) permits a portion 52*a* of the base member 52 to pivot relative to another portion 52*b* of the base member 52, which is illustrated in schematic fashion in FIG. 13. In such an arrangement, the base member 52 may move from a substantially planar orientation, as illustrated in solid line, to a non-planar, or flexed orientation, as illustrated in dashed line, in response to an external force applied to the box 260. Accordingly, an amount of movement of the article 92 relative to the support walls and box 260 is permitted in addition to relative movement provided by the support walls formed by the foldable portions 54 and 56, as indicated by the relative positions of the article 92 shown in solid line and dashed line. The fold line 208 may be configured to provide a desired amount of movement, in a manner similar to that described above with reference to the fold lines 200, for example.

In one embodiment, relative movement of the article 92 is permitted by the compound joints 124, 128, 164, 168, the foldable portions 58, 60, and the fold line 208. However, in other embodiments, the desired relative movement may be provided by such structures individually, or in any desired combination. Furthermore, the structures described herein may be used in combination with other relative-movement-permitting structures, devices or assemblies, if desired. Preferably, such structures are individually configured to provide a desired amount of relative movement of the article 92 with consideration of all of the structures present in any particular embodiment that permit relative movement, along with other considerations, such as weight of the article(s), for example.

In addition, although it is preferred that the base member 52 is supported by a pair of support walls at opposing sides of the base member 52, in other arrangements, a fewer or greater number of support walls may be provided. For example, in one possible embodiment, a single wall may be provided and an opposing end of the base member 52 may rest directly on a support surface. In such an arrangement, the base member 52 may pivot about the portion resting directly on the support surface in accordance with movement permitted by the single wall. In other embodiments, the base member 52 may be supported by support walls on all sides, with one or more of the supports walls permitting relative movement of the base member 52.

Figure 14:
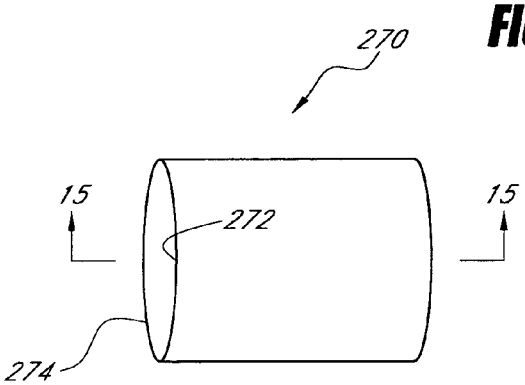
FIG. 14 is a perspective view of a modification of the retention member of FIG. 3. The retention member of FIG. 14 is in the form of a flattened tube.
Figure 15:
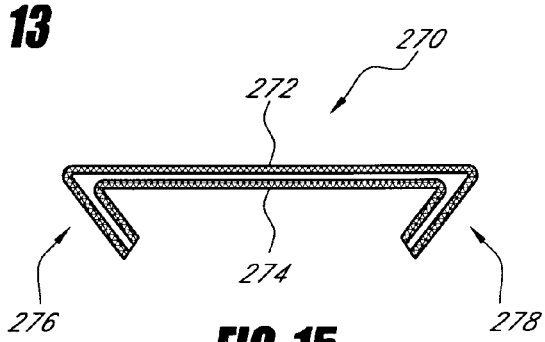
FIG. 15 is a cross-sectional view of the retention member of FIG. 14 taken along line 15-15 in FIG. 14, with the end portions of the retention member illustrated in a folded orientation.

FIGS. 14 and 15 illustrate a modification of the resilient member 70 of FIG. 3. The resilient member of FIGS. 14 and 15 is referred to by the reference number 270. The resilient member 270 preferably is substantially similar to the resilient member 70 in structure and function, except that the resilient member 270 is a flattened, tubular structure in which a first sheet 272 and a second sheet 274 each extend an entire length $L_2$ of the resilient member 270. Thus, the first and second sheets 272, 274 cooperate to form a continuous, annular wall of the resilient member 270. The resilient member 270 may be a monolithic structure constructed from, for example, an extrusion and blow-molding process. Alternatively, the resilient member 270 may be constructed from a single sheet of material that is folded lengthwise onto itself to create the first and second sheets 272, 274. In another modification, the resilient member 270 may be constructed from two separate sheets of material, which may correspond with the first and second sheets 272, 274. The sheets 272, 274 may be connected to one another, by any suitable method such as those disclosed in connection with the resilient member 70 of FIG. 3.

As illustrated in FIG. 15, the open end portions of the resilient member 270 may be folded to create pockets 276 and 278, similar to the pockets 74 and 76 of the resilient member 70, illustrated in FIG. 3. Desirably, the pockets 276, 278 are configured to engage the foldable portions 58, 60 of the packaging member 50 such that the resilient member 270 may be tensioned by folding of the foldable portions 58, 60. Although the sheets 272, 274 may be of any suitable thickness, in FIG. 15, the thickness has been exaggerated for the purpose of clarity.

In an alternative embodiment, the resilient member may be constructed from two separate sheets of material which extend on opposing upper and lower sides of the base member 52 or from a single sheet of material folded over the base member 52 to create sheet portions on each side. The sheets of material may be joined together, such as along a portion of each end to form pockets similar to the pockets 74 and 76 of FIG. 3 and/or using couplers similar to the couplers 106 of FIG. 5. Article(s) may be positioned between one sheet and the base member 52, while the other sheet may be non-functional except for retaining the resilient member to the packaging member 50 through the pockets and/or couplers. Such an arrangement lends itself to incorporation into the manufacturing process for constructing the packaging member 50.

Figure 16:
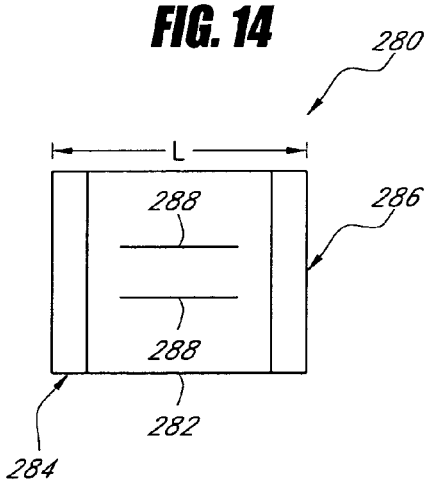
FIG. 16 is a perspective view of yet another modification of the retention member of FIG. 3. The retention member of FIG. 16 includes one or more slits and an intermediate portion of the retention member.
Figure 17:
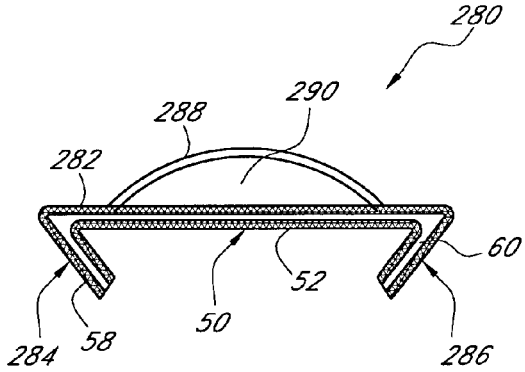
FIG. 17 illustrates the retention member of FIG. 16 assembled to a packaging member. As illustrated, the slit creates an opening to access the space between the retention member and the base member to permit an article to be positioned between the retention member and the base member after the retention member has been assembled to the packaging member.

FIGS. 16 and 17 illustrate yet another modification of the resilient member 70 of FIG. 3. The resilient member of FIGS. 16 and 17 is referred to generally by the reference numeral 280. The resilient member 280 preferably is substantially similar to the resilient member 70. The resilient member 280 includes a body 282, which terminates at opposing ends in first and second pockets 284, 286. Alternatively, the resilient member 280 may be similar in construction to any of the resilient members described above, such as the member 270, for example, or of any other suitable construction.

The body 282 of the resilient member 280 includes one or more slits 288. The illustrated resilient member 280 includes a pair of slits 288, however, other suitable numbers of slits may also be used. Preferably, the slits 288 are located in a generally central location of the body 282 and are oriented along the length L of the body 282. Accordingly, when the resilient member 280 is tensioned, such a construction inhibits the slits 288 from propagating, or tearing further into the body 282 from the ends of the slits 288.

The slits 288 facilitate the positioning or removal of an article between the resilient member 280 and the packaging member 50 after the resilient member 280 is engaged with the packaging member 50. As illustrated in FIG. 17, the portions of the body 282 on either side of the slit 288 may be separated from one another, preferably in a direction generally perpendicular to the body 282, to create an opening 290 which communicates with a space between the resilient member 280 and the packaging member 50. The opening 290 preferably is sized to permit a desired article to be passed through the opening 290 and into the space between the resilient member 280 and the packaging member 50 while the resilient member 280 is engaged with the packaging member 50. Thus, the length of the slit 288 may be determined by the size of the article to be packaged. As illustrated in FIG. 17, the foldable portions 58, 60 of the packaging member 50 may be folded to tension the resilient member 280 to secure the article to the packaging member 50.

Although the present inventions have been described in terms of certain embodiments, other embodiments apparent to those of ordinary skill in the art also are within the scope of these inventions. Thus, various changes and modifications may be made without departing from the spirit and scope of the inventions. For instance, various components may be repositioned as desired. Moreover, not all of the features, aspects and advantages are necessarily required to practice the present inventions.

What is claimed is:

1. A suspension packaging member comprising a single-piece foldable member which comprises:

a base configured to engage an article; and first and second support walls connected to the base through first and second compound joints, respectively, the first and second compound joints configured to permit the first and second support walls to be moved relative to the base from an unfolded position to a folded position and the first and second support walls to be generally parallel to each other in the folded position, the first and second compound joints further configured to permit displacement of the base relative to the first and second support walls in a direction generally parallel to the first and second support walls when the first and second support walls are in the folded position, wherein each of the first and second support walls comprises a first end and a second end to form a bottom end and a top end, respectively, when the first and second support walls are in the folded position, wherein the base is disposed at an elevation between the bottom end and the top end when the first and second support walls are in the folded position.

2. The packaging member of claim 1, wherein the single-piece foldable member further comprises a connecting wall between the base and the first support wall, wherein the connecting wall is positionable in a generally parallel orientation relative to the first support wall when the first support wall is in the folded position.

3. The packaging member of claim 2, wherein the connecting wall is between the base and the first compound joint.

4. The packaging member of claim 1, further comprising a fold line extending at least partially through the base.

5. The packaging member of claim 4, wherein the fold line in the base extends completely through the base in a direction substantially parallel to the first support wall.

6. The packaging member of claim 1, wherein the first compound joint comprises a plurality of relatively more rigid segments separated by a plurality of fold lines defining a plurality of relatively less rigid segments.

7. The packaging member of claim 1, wherein the single-piece of foldable member is formed of a single-piece cardboard blank.

8. A suspension packaging member comprising:

a single-piece foldable member which comprises:

a base configured to engage an article, first and second support walls connected to the base through first and second compound joints, respectively, the first and second compound joints configured to permit the first and second support walls to be moved relative to the base from an unfolded position to a folded position and the first and second support walls to be generally parallel to each other in the folded position, the first and second compound joints further configured to permit displacement of the base relative to the first and second support walls in a direction generally parallel to the first and second support walls when the first and second support walls are in the folded position, and a connecting wall between the base and the first support wall, wherein the connecting wall is positionable in a generally parallel orientation relative to the first support wall when the first support wall is in the folded position; and a coupler configured to retain the connecting wall in the generally parallel orientation relative to the first support wall.

9. A suspension packaging member, comprising:

a base configured to engage an article;

at least one support wall connected to the base through a compound joint configured to permit the at least one wall to be moved relative to the base from an unfolded position to a folded position, the compound joint further configured to permit displacement of the base relative to the wall in a direction generally parallel to the wall when the wall is in the folded position;

a connecting wall between the base and the support wall, wherein the connecting wall is positionable in a generally parallel orientation relative to the support wall when the support wall is in the folded position; and a coupler configured to retain the connecting wall in the generally parallel orientation relative to the support wall, wherein the coupler comprises a tab secured to one of the connecting wall and the support wall and a slot defined by the other of the connecting wall and the support wall, the tab and the slot configured, once the tab is engaged with the slot, to cooperate to retain the tab in engagement with the slot.

* * * * *